US010648462B2

(12) United States Patent
Monsen et al.

(10) Patent No.: US 10,648,462 B2
(45) Date of Patent: May 12, 2020

(54) SYSTEM FOR FEEDING AND PUMPING OF LESS PUMPABLE MATERIAL IN A CONDUIT LINE

(71) Applicant: THERMTECH HOLDING AS, Paradis (NO)

(72) Inventors: Stein Kyrre Monsen, Bergen (NO); Erik Michelsen, Fanna (NO)

(73) Assignee: THERMTECH HOLDINGS AS, Paradis (NO)

( * ) Notice: Subject to any disclaimer, the term of this patent is extended or adjusted under 35 U.S.C. 154(b) by 721 days.

(21) Appl. No.: 15/033,284

(22) PCT Filed: Oct. 29, 2014

(86) PCT No.: PCT/NO2014/050203
§ 371 (c)(1),
(2) Date: Apr. 29, 2016

(87) PCT Pub. No.: WO2015/065198
PCT Pub. Date: May 7, 2015

(65) Prior Publication Data

US 2016/0281694 A1 Sep. 29, 2016

(30) Foreign Application Priority Data

Oct. 29, 2013 (NO) ..... 20131429

(51) Int. Cl.
*F04B 39/00* (2006.01)
*F04B 15/02* (2006.01)
(Continued)

(52) U.S. Cl.
CPC ..... *F04B 39/0027* (2013.01); *F04B 11/00* (2013.01); *F04B 15/02* (2013.01);
(Continued)

(58) Field of Classification Search
CPC ..... F04B 39/0027; F04B 39/005; F04B 39/0055; F04B 39/0061; F04B 39/0066;
(Continued)

(56) References Cited

U.S. PATENT DOCUMENTS 2,934,025 A * 4/1960 Wilson ..... F04B 11/0016 138/31
2,998,781 A 9/1961 Triebel
(Continued)

FOREIGN PATENT DOCUMENTS

WO 2009041811 A1 4/2009

OTHER PUBLICATIONS

"Single piston pump based on the thrust principle (The EKO series)," Putzmeister, IP 2253-3 GB. Printed in Germany; Unknown date in 2010.

*Primary Examiner* — Bryan M Lettman
(74) *Attorney, Agent, or Firm* — Flener IP & Business Law; Zareefa B. Flener; Ayhan E. Mertogul

(57) ABSTRACT

A system for feeding and pumping of less pumpable material in a conduit line (28) is disclosed, comprising at least one main pump (10) for feeding of said less pumpable material into the conduit line (28), and a receiver unit (50) for receipt of the less pumpable material from the conduit line (28), wherein one or more independent driven compensators (40) are included in the conduit line (28) to maintain stable flow, said one or more compensators (40) being a fillable chamber (14;70) adapted to controllably being pressurized for additional feeding of the material through the conduit line.

11 Claims, 5 Drawing Sheets

(51) Int. Cl.
*F04B 53/00* (2006.01)
*F04B 11/00* (2006.01)
*F04B 49/22* (2006.01)

(52) U.S. Cl.
CPC ..... *F04B 49/22* (2013.01); *F04B 53/001* (2013.01); *F04B 2205/05* (2013.01); *F04B 2205/13* (2013.01)

(58) Field of Classification Search
CPC .. F04B 39/0088; F04B 53/001; F04B 53/004; F04B 11/0016; F04B 11/0025; F04B 11/0033; F04B 11/00; F04B 11/0008; F04B 15/02; F04B 2205/05; F04B 2205/13; F04B 49/22
See application file for complete search history.

(56) References Cited

U.S. PATENT DOCUMENTS 3,266,435 A * 8/1966 Smith ..... F04B 9/02 222/409
3,303,786 A * 2/1967 Fanshawe ..... F01L 23/00 417/392
3,477,380 A 11/1969 Johanson et al.
4,142,497 A * 3/1979 Long ..... F02D 21/08 123/456
4,181,137 A * 1/1980 Conti ..... C10M 173/02 137/13
5,106,272 A 4/1992 Oakley et al.
5,127,806 A 7/1992 Benckert
5,330,327 A * 7/1994 Anderson ..... F04B 7/0258 417/53
5,388,965 A 2/1995 Fehn
5,520,521 A 5/1996 Benckert et al.
6,234,758 B1 * 5/2001 Pawelski ..... F04B 11/0016 417/26
6,644,930 B1 * 11/2003 Kuismanen ..... F04B 15/02 417/393
2006/0245943 A1 11/2006 Hofmann
2010/0196178 A1 * 8/2010 Sjogren ..... F04B 13/00 417/415
2012/0145743 A1 * 6/2012 Ikushima ..... B05C 5/0225 222/1

* cited by examiner

SYSTEM FOR FEEDING AND PUMPING OF LESS PUMPABLE MATERIAL IN A CONDUIT LINE

The present invention relates to a system for feeding and pumping of less pumpable material in a conduit line, to ensure a stable flow rate.

One of the main objectives of the invention is to provide a system that can pump "less pumpable materials" (e.g., dry materials, sticky materials, high viscosity material, etc.) with a stable flow in a conduit line.

Traditional piston pumps are unable or less efficient at transporting materials such as sticky or dry materials due to high viscosity or low mobility. These pumps do not generate a stable flow due to the "pump brake", which occurs when one of the pistons changes stroke direction.

When continuous and uniform flow-rate of the feed is required, the available pumps (specifically piston pumps) are missing such a feature in situations. The non-continuity/uniformity of the flow rate can be because of stroke change in a double piston pump, when the cylinders are switching. In other words, when the first piston reaches to the end of the first cylinder, it should go back and the outlet of the pump switches from the first cylinder to the second one and the second piston should start moving forward. In this moment of switching the cylinders and changing the pistons moving direction, there will be a missing flow-rate for a moment and flow rate drop. Companies are trying to decrease this time as much as possible by making the switching time as short as possible.

The non-continuity/uniformity of the flow rate can also be because of line clogging. As the pumped material are usually difficult to pump, the operation faces with clogging of the feed line (the line that pressure is created by the pump). In case of clogging, the flow rate drops.

A system according to the invention can resolve transportation and if needed flow stability issues of such less pumpable materials.

In a feeding system as disclosed in the application, a filling mechanism for the less pumpable material may be by using gravity force (weight) to fill a chamber. The materials can enter into a pump chamber through an opening after which the chamber is closed (for example by rotation or other closing mechanism) before a piston starts its transportation/movement. The filling mechanism may be assisted by external mechanisms such as sloped walls or any external force such as pressurized gas/liquid, vibration, etc. to ensure the chamber is filled sufficiently and simultaneously.

Outlet of the less pumpable material can be controlled by using a valve, for instance a gate valve/guillotine valve, to close/open the chambers. "S-Tube" is normally used for such a purpose.

A gate valve, also referred to as a sluice valve, is a valve that opens and closes to regulate flow. A gate valve normally opens by lifting a rectangular or round gate or wedge, often called a sliding door, out of the path to allow flow though.

The valve can be a linear or rotary valve, like a gate valve, globe valve, ball valve, butterfly valve, etc.

If several chambers are used in the pump, each chamber can be operated in independent sequences. The sequences can be set up in such a way that the feeding, retraction and filling functionalities are optimized to ensure stable pumping. Preferable the pistons are moving separately in different directions in the chambers. However, it is also possible for the pistons to move in the same direction. The highest flow rate variation in old designs occurs when the pistons are switching (which is called pump brake). In the system described this brake never occurs. In a portion of stroke both pistons can be moving in the same direction and one of them is in front. When the front piston switches the direction (comes back) the other one still goes forward. So no brake happens. If very accurate flow rate is required it is possible to slow down the first piston close to the end of the stroke and speed up the other one. Using more than two chambers can also assist to more stable flow rate.

The chamber may comprise a piston for feeding of the less pumpable material into a conduit line. The movement and speed of each piston can be controlled independently. This enables the pistons to move in the same or different directions (e.g. forwards and backwards) at any given speed to avoid any interruption in the flow. Control of the pistons can be implemented by simple mechanical switches for easy ones or PLC for more sophisticated designs, and be controlled by a control system.

In order to avoid any interruptions in flow, which may occur for some materials, one or more compensators according to the invention can be added to the pumping line to compensate for the drop in the flow rate. These additional compensators can be an integrated part of the main pump or can be used as an independent armature anywhere in the pumping line. This extra pumping function can be used in combination with all traditional piston pumps to resolve flow instabilities.

When compensation is required, the piston(s) in the additional compensators starts moving and continues as required to maintain constant flow.

Control of the compensators can be implemented by simple mechanical switches for easy ones or PLC for more sophisticated designs, and be controlled by a control system.

For very sticky materials, a self cleaning system with a gas line (with, for example, Nitrogen or air) may be used to remove all types of deposits and/or settled materials. This gas line is supplying sufficient pressure to release and/or unsettle those materials, by using pressurized gas to clean the chambers internal walls. Control and actuating of the self cleaning system can be by stroke or piston load, or by the control system.

It is thus an objective of the invention to provide system according to the above.

Said objectives and other objectives, are achieved with a system for feeding and pumping of less pumpable material in a conduit line, comprising at least one main pump for feeding of said less pumpable material into the conduit line, and a receiver unit for receipt of the less pumpable material from the conduit line, wherein one or more independent driven compensators are included in the conduit line to maintain stable flow, said one or more compensators being a fillable chamber adapted to controllably being pressurized for additional feeding of the material through the conduit line.

Alternative embodiments are disclosed in the dependent claims.

A control system is preferable connected to said compensators, which during operation is arranged to generate a function, based on position, velocity and pressure of the material in the conduit line, and to generate action signals to the compensator to increase, reduce or maintain the flow rate.

The control system receives signals from the main pump and the receiver unit for determining said function.

The chamber of the compensator can be a filling chamber with an inlet opening for input of the material into the chamber, and an outlet aperture for outlet of the material into the conduit line, and with valves arranged to controllably close or open the aperture in the chamber, dependent on action signals from a control system.

The filling chamber can be equipped with an internal piston, connected to a piston rod, for feeding of the material out an outlet aperture, and wherein the piston rod is connected to a drive means for operation of the piston and the piston rod, said drive means being controlled dependent on action signals from a control system.

The chamber of the compensator can be a filling chamber with an open opening for receipt of material from the conduit line into the chamber, and a spring loaded piston arranged to feed material into the conduit line through said opening.

The chamber or chambers of the compensator may receive material from the conduit line when the flow rate is high, and feed material to the conduit line when the flow rate is low.

Two or more chambers can be placed in a cooperative configuration, and wherein each chamber is arranged to operate in independent sequences to ensure stable flow of the less pumpable material in the conduit line.

Each chamber may comprise a piston for pressurizing the material, and wherein forward or backward movements of the pistons are controlled independently by the control system, said control system being operable to; move the piston of a first chamber forward in the chamber, while the piston in a second chamber is held still, initiate movement of the piston in the second chamber, when the piston in the first chamber is slowing down, and move the piston in the second chamber forward in the chamber, while the piston in the first chamber is moving backward.

The control system may also be operable to control a third chamber, wherein stroke of a piston in the third chamber overlaps the stroke of the pistons of the first and second chambers.

The compensators according to the invention are preferably integrated in the conduit line, and/or mounted to the conduit line.

The chamber(s) may alternative comprise or be connected to a cleaning system supplying pressurized gas to clean the inside of the chamber wall.

The cleaning system supplying pressurized gas is activated when needed, or based on stroke or piston load in the chamber.

The main pump in the system may comprise one or more filling chambers according to the above disclosed chambers.

The system may also comprise a lubrication arrangement for lubrication of the inside of the conduit line, said lubrication arrangement being adapted to receive lubricant from the compensators and to provide lubricant through apertures in a wall of the conduit line, based on input from the control system, or at predetermined intervals.

An example of the invention shall now be described in more detail with the help of the enclosed figures, wherein.

Figure 1:
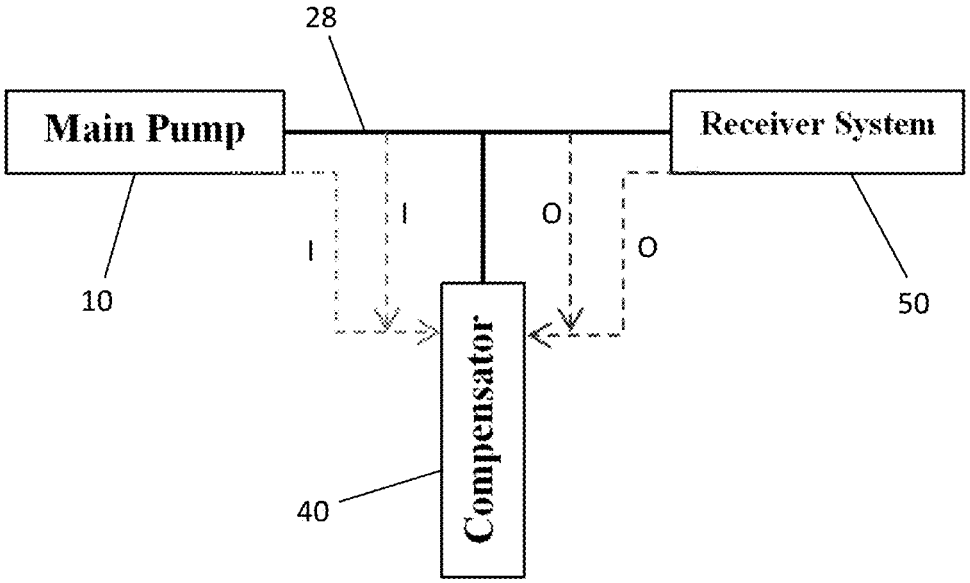
FIG. 1 shows a system according to the invention.

FIG. 1 shows a basic overview of the system according to the invention, and comprises a main pump 10 for pumping and feeding of less pumpable material into a conduit line 28, and where said less pumpable material is feed to a receiver unit or system 50 for any kind of further processing and handling of the material. In the conduit line 28, or connected to the conduit line, a number of compensators 40 can be connected in order to avoid any interruptions in the flow, which may occur for some materials, to compensate for drop in the flow rate. The compensator 40 receives input signals I from the main pump 10, and receives output signals O from the receiver system 50.

Figure 2:
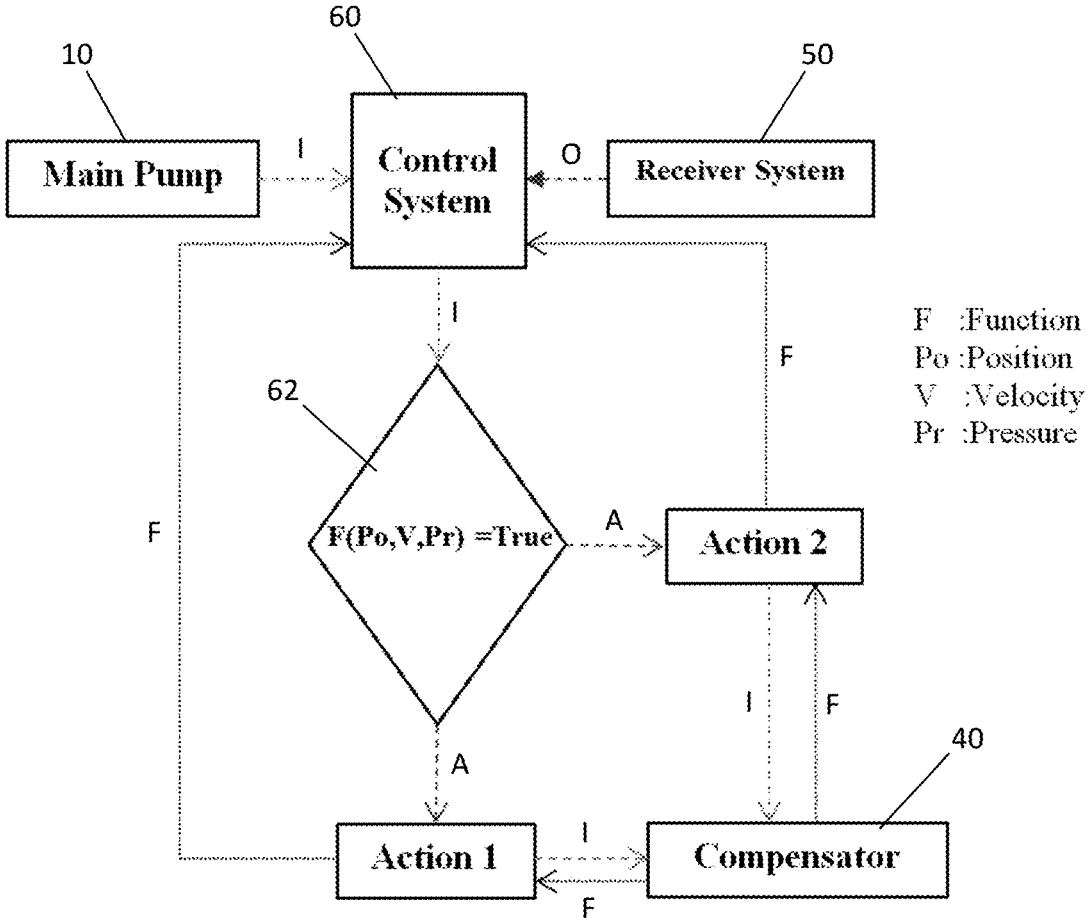
FIG. 2 shows a control system implemented in the system according to the invention.

FIG. 2 shows an overview of a control system 60 implemented in the system according to the invention, for control of the compensator 40 and possible the main pump 10. Based on position, velocity and pressure of the material in the conduit line 28, the compensator 40 will be triggered to increase, reduce or maintain the flow rate in the conduit line 28 based on signals received in the control system 60. Said signals coming from for instance the main pump or receiver system, but the signals may also come from meters within the conduit line 28.

A logic unit 62 in the control system 60 will then, based on the signals, generate a function, based on said position, velocity and pressure of the material in the conduit line, and generate action signals $A_1, A_2 \ldots A_n$ to the compensator 40 to increase, reduce or maintain the flow rate. Feedback signals F are sent back to the control system 60, dependent on the actions taken.

In FIGS. 1 and 2:

I—Input signals

O—Output signals

A—Action signals

F—Feedback signals

Figure 3:
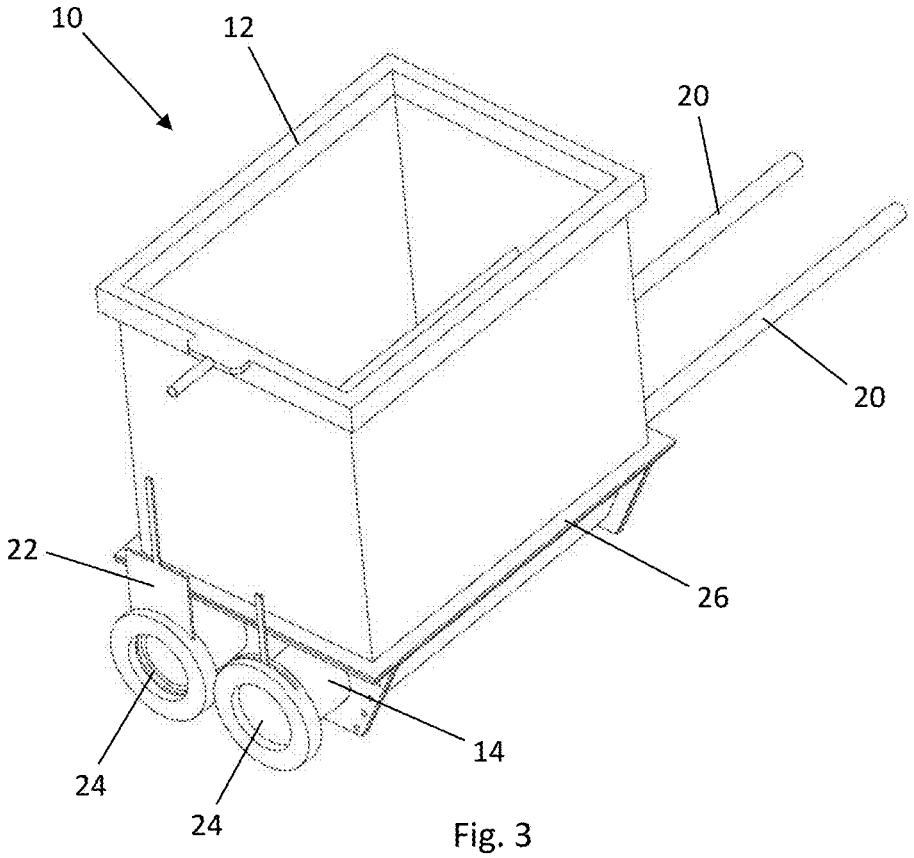
FIG. 3 shows a feeding arrangement that can be implemented in a system according to the invention.
Figure 4:
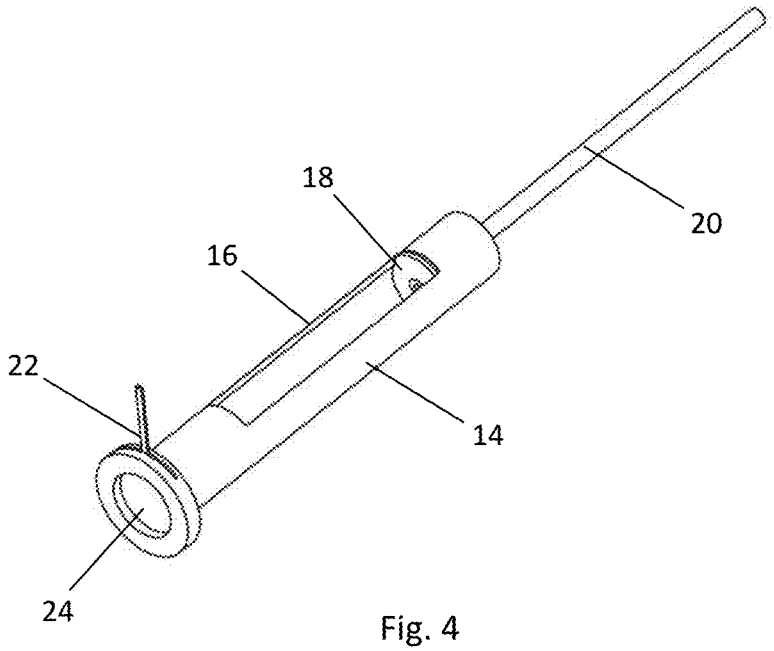
FIG. 4 shows a perspective view of a compensator/filling chamber in the feeding arrangement.

As seen in FIG. 3, as an example, a main pump 10 for less pumpable material may comprises a receptacle 12 for receipt of the less pumpable material. It should however be noted that any type of main pump can be used. The receptacle 12 may be in the form of an open container or basket, and may comprise sloped walls or other means in order to ease filling of the receptacle and/or a filling chamber 14. In the lower part of the receptacle 12 is one or more filling chambers 14 located. The filling chambers 14 can be arranged in a base 26, and the receptacle can be placed on the base.

The receptacle 12 can be filled with the less pumpable material in any way, and the material can flow into the filling chambers 14 by gravity, i.e. by its weight, and/or be assisted by external means like vibration, pressurization, etc.

The filling chamber 14, as shown in the figures, comprises a longitudinal hollow cylinder with an internal piston 18, which can move backward and forwards in the cylinder chamber for pressurizing the material in the chamber. The piston 18 is connected to a piston rod 20, and the piston rod is connected to any suitable drive means. The filling chamber 14 further comprises an inlet opening 16 for receipt of the less pumpable material into the chamber, and an outlet opening or aperture 24 for feeding of the material into a conduit line 28. The inlet opening 16 is equipped with a closing mechanism (not shown in detail) which will close when the filling chamber is full or when the filling chamber is filled to a predetermined level. The chamber 14 can also be closed by rotation of the cylinder.

The outlet aperture 24 may comprises a valve 22 for closing and opening of the aperture. The valve 22 may be in any form of a closable or openable valve, for instance a gate valve or a guillotine valve. When the valve 22 is open, the filling chamber 14 is in a closed feeding state, thus permitting outlet of the material into the conduit line through the aperture 24 by movement of the piston 18. When the valve 22 is closed, the filling chamber 14 is in an open filling state, with the inlet opening 16 open, thus blocking feeding of material into the conduit line.

Figure 5:
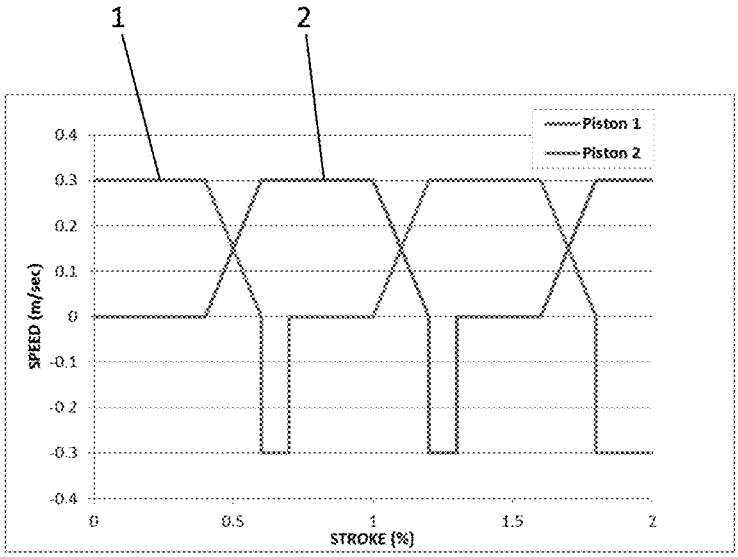
FIGS. 5 and 6 show stroke and speed diagrams of piston movement in the filling chamber.
Figure 6:
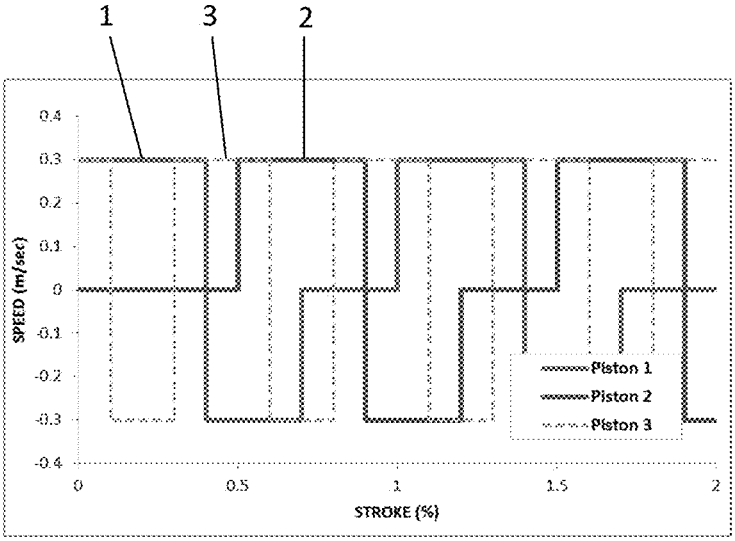

Two or more filling chambers 14 can be used for cooperative feeding of material into the conduit line. However, it should be noted that only one chamber may be used in certain circumstances. The two chambers 14 can be driven in independently sequences, as shown in FIG. 5. The same applies for three chambers, which is shown in FIG. 6. The sequences can be set up in such a way that the feeding, retraction and filling functionalities are optimized to ensure stable pumping, dependent on the number of chambers used, characteristic of the conduit line and characteristic of the less pumpable material, or any other important factors. The main feature compared with available pumps is that every chamber is controlled independently.

The system further comprises a controller (not shown) for control of the chambers, in where control can be implemented by simple mechanical switches for easy and simple systems, or PLC for more sophisticated designs. A Programmable Logic Controller, PLC or Programmable Controller, is a digital computer used for automation of electromechanical processes. The controller is preferable connected to the control system 60

FIG. 5 shows an example of speed diagram with two chambers (negative speed means backward movement), for a two chambers pump when a stable flow is required. At start of the diagram a first piston 1 is moving forward in a first chamber, for feeding of the material, while a second piston 2 in a second chamber is standing still, for instance for filling the second chamber. When the first piston 1 is approaching the end of the stroke, the second piston 2 starts its forward movement. When the first piston 1 is moving backward, the second piston 2 is moving forward at normal speed. The piston strokes are then repeated. It should be noted that the pistons can be driven in other sequences or strokes as shown in the figures, also partially overlapping each other.

In FIG. 6 another sequence is shown, using three chambers 14. Piston 1 and 2 are basically moving as described above, except that the second piston 2 starts after the first piston 1 has started its backward movement. In the overlap between the strokes of piston 1 and 2, a third piston 3 in a third chamber can be driven and moving forward at normal speed, thus ensuring even better feeding and continuous flow of the material into the conduit line.

According to the invention, the system comprises one or several compensators 40 installed in the conduit line 28, i.e. in the conduit line 28 between the main pump 10 and receiver unit 50, or cooperating with the main pump 10. The compensators will insure and maintain constant and stable flow in the line 28. The compensators 40 can be designed, operated and controlled similar to the above mentioned filling chamber 14. The chamber 14 or chambers of the compensator 40 can receive material from the conduit line, for instance when the flow rate is high, and feed material to the conduit line 28 when the flow rate is low, thus maintaining a stable flow rate. However, it may also be possible to fill the chambers of the compensator 40 gradually during feeding of material through the conduit line 28, such that the compensator is ready to feed extra material into the conduit line if the flow rate suddenly drops. Material can be feed to the inlet opening 16, or a suitable other opening, for receipt of the less pumpable material into the chamber, and out through the outlet opening or aperture 24 for feeding of the material into the conduit line 28 based on the action signals from the control system 60. The inlet opening 16 may in the same manner be equipped with a closing mechanism which will close when the filling chamber is full or when the filling chamber is filled to a predetermined level.

Figure 7:
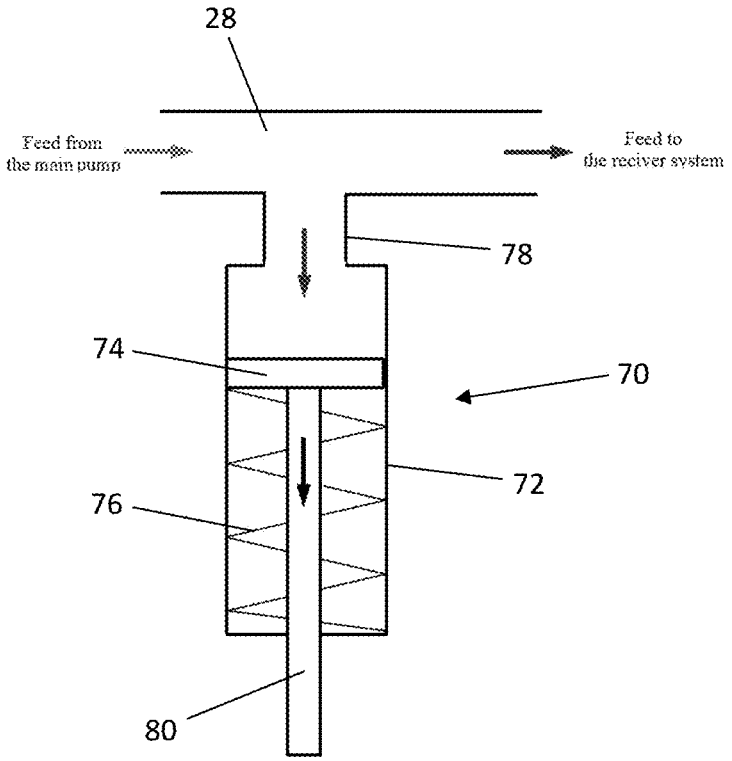
FIGS. 7 and 8 show a spring/self-adjusted compensator that can be included in the system according to the invention.
Figure 8:
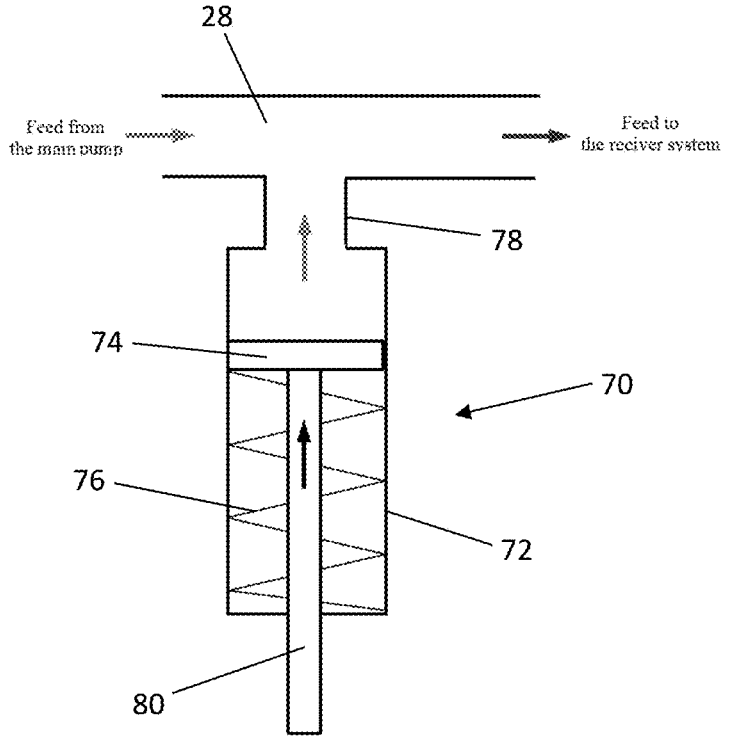

FIGS. 7 and 8 show a different and alternative filling chamber 70 for the compensator 40, but with the same functions as previously disclosed. The filling chamber 70 comprises in the same manner a housing 72, for instance in the form of a longitudinal hollow cylinder, with an internal piston 74, which can move backward and forwards in the cylinder chamber. The piston 74 is connected to a piston rod 80, and the piston rod may be connected to any suitable drive means. The filling chamber 70 further comprises an open inlet opening 78 for receipt of the less pumpable material into the chamber, in where said inlet opening also functions as the outlet opening for feeding of the material back into the conduit line 28. The filling chamber 70 of the compensator can be somewhat self-adjustable to maintain stable flow rate, in that forward and backward motion of the piston 74 is regulated by for instance a spring 76. When the flow rate is high, the pressure from the material in the conduit line 28 will be higher then the spring force acting on the piston 74, thus forcing the piston backwards and filling the housing 72. When the flow rate is low, the spring force will be higher then the pressure from the material in the conduit line 28, thus forcing the piston forward and feeding material into the conduit line, and maintaining a stable flow rate. Movement of the piston 74 is indicated by the arrows. The control system 60 can be connected to the drive means for further control of the piston rod 80 as disclosed previously.

Figure 9:
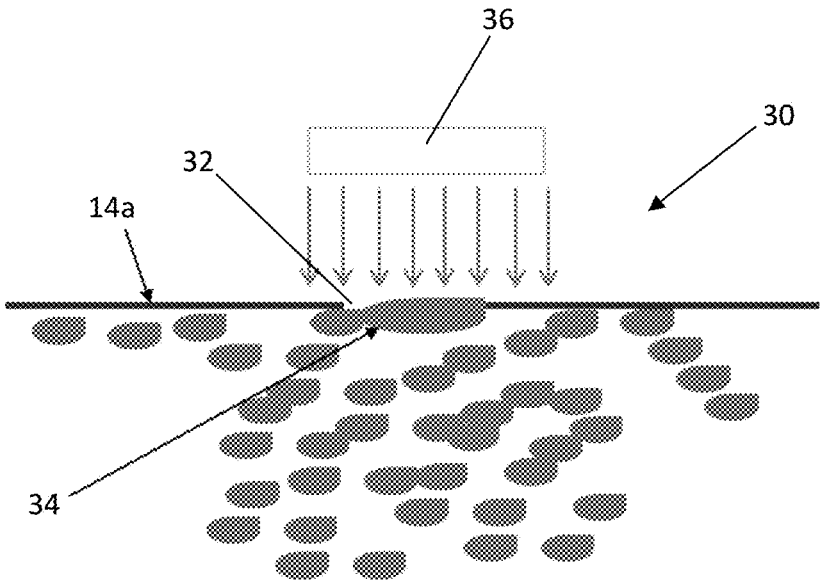
FIG. 9 shows a cleaning system implemented in the system according to the invention.

The system according to the invention may further also comprise a self cleaning system 30, as schematically shown in FIG. 9, in that the chamber 14, the chamber 70 or the conduit line 28 comprises or is connected to a device 36 supplying pressurized gas to clean the inside of the chamber wall or line. The pressurized gas can be supplied to the inside of the chambers internal wall 14*a* by small apertures 32 or valves in the wall in order to remove all types of deposits/bridges and/or settled materials 34. The gas line is supplying sufficient pressure to release and/or unsettle those materials. The cleaning system supplying pressurized gas is normally activated when needed, or based on stroke or piston load in the chamber 14,70. In the latter case, the cleaning system can be PLC controlled and connected to the control system 60.

Figure 10:
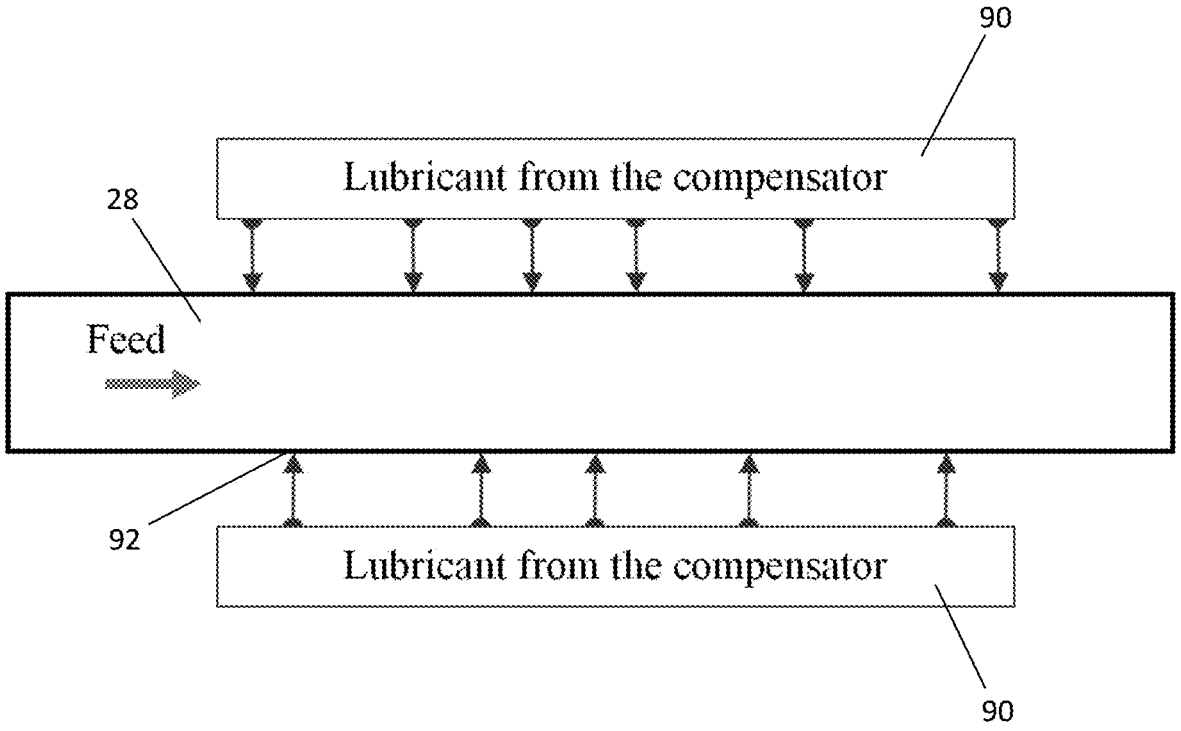
FIG. 10 shows means for lubrication of the material in the conduit line, and which can be included in the system according to the invention.

As shown in FIG. 10, the system may also comprise a lubrication arrangement 90 for lubrication of the inside of the conduit line 28. The compensator 40 can be adapted to provide lubricant through preferable small apertures 92 in the conduit line 28, based on input from the control system 60, or at predetermined intervals.

The invention claimed is:

1. A system for feeding and pumping of less pumpable material in a conduit line, comprising:

at least one pump for feeding of said less pumpable material into the conduit line, the at least one pump comprising two or more independently driven pump chambers;

a receiver unit for receipt of the less pumpable material from the conduit line; and a control system, wherein during operation the control system is arranged to generate a function, based on position, velocity and pressure of the material in the conduit line, and to generate action signals ($A_1$, $A_2$, . . . $A_n$) to increase, reduce or maintain the flow rate, wherein the control system receives signals from the at least one pump and the receiver unit for determining said function, and said each of the two or more independently driven pump chambers comprises an inlet opening for input of the material into the two or more independently driven pump chambers, an outlet aperture for outlet of the material into the conduit line, and a valve arranged to controllably close or open the outlet aperture based on the action signals from the control system.

2. The system according to claim 1, wherein each of the two or more independently driven pump chambers comprises a piston for feeding of the material out through the outlet aperture, and wherein each piston is driven by a piston rod based on the action signals from the control system.

3. The system according to claim 2, wherein the control system controls the movement of the piston in each of the two or more independently driven pump chambers independently, said control system being operable to move the piston in a first pump chamber of the two or more independently driven pump chambers toward the conduit line while the piston in a second pump chamber of the two or more independently driven pump chambers is held still, initiate movement of the piston in the second pump chamber toward the conduit line when the piston in the first pump chamber is slowing down, and move the piston in the second pump chamber toward the conduit line while the piston in the first pump chamber is moving away from the conduit line.

4. The system according to claim 1, further comprising one or more compensators disposed along the conduit line, each comprising a fillable chamber outside of the conduit line and in fluid communication with the conduit line, wherein the fillable chamber is adapted to be controllably pressurized for increasing, decreasing, or maintaining a flow rate of the material through the conduit line, and wherein said fillable chamber comprises an opening for receipt of the material from the conduit line into the fillable chamber, and a spring loaded piston arranged to feed the material into the conduit line through said opening.

5. The system according to claim 4, wherein the fillable chamber receives the material from the conduit line when the flow rate through the conduit line is high, and feeds the material to the conduit line when the flow rate through the conduit line is low.

6. The system according to claim 4, wherein the one or more compensators are integrated into the conduit line and/or mounted to the conduit line.

7. The system according to claim 1, wherein the two or more independently driven pump chambers are disposed in a cooperative configuration, and wherein each of the two or more independently driven pump chambers is arranged to operate in independent sequences to ensure stable flow of the less pumpable material through the conduit line.

8. The system according to claim 1, wherein at least one of the two or more independently driven pump chambers comprises or is connected to a cleaning system supplying pressurized gas to clean an inside wall of the at least one pump chamber.

9. The system according to claim 8, wherein the cleaning system is activated when needed, or based on stroke of or load on the piston in the at least one pump chamber.

10. The system according to claim 1, wherein the system comprises a lubrication arrangement for lubrication of the inside of the conduit line, said lubrication arrangement being adapted to receive lubricant from one or more compensators and to provide lubricant through apertures disposed through a wall of the conduit line based on input from the control system or at predetermined intervals.

11. The system according to claim 1, wherein one or more compensators are disposed along the conduit line to maintain stable flow, said one or more compensators comprising a fillable chamber adapted to controllably being pressurized for additional feeding of the material through the conduit line.

* * * * *